US008116477B2

(12) United States Patent
Lee et al.

(10) Patent No.: US 8,116,477 B2
(45) Date of Patent: Feb. 14, 2012

(54) FIT ADJUSTER FOR A NECKBAND TYPE HEADSET

(75) Inventors: Seung-Jae Lee, Suwon-si (KR); Ki-Yeol Yoon, Suwon-si (KR); Ki-Taek Kim, Yongin-si (KR); Young-Ki Kim, Yongin-si (KR); Jae-Chul Jin, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 1219 days.

(21) Appl. No.: 11/838,048

(22) Filed: Aug. 13, 2007

(65) Prior Publication Data

US 2008/0037816 A1 Feb. 14, 2008

(30) Foreign Application Priority Data

Aug. 11, 2006 (KR) ..... 10-2006-0076408

(51) Int. Cl.
*H04R 1/02* (2006.01)

(52) U.S. Cl. ..... 381/87; 24/437; 24/71 R; 24/71 ST; 24/439; 2/417; 2/420

(58) Field of Classification Search ..... 24/437–441, 24/71 R, 71 J, 71 T, 71 ST; 381/87; 2/417–420
See application file for complete search history.

(56) References Cited

U.S. PATENT DOCUMENTS 1,764,440 A * 6/1930 Gammell et al. ..... 24/68 J
2,205,742 A * 6/1940 Bowers ..... 2/8.1
2,437,748 A * 3/1948 Malcom ..... 2/183
2,461,309 A * 2/1949 Cedar ..... 24/71 R
2,550,575 A * 4/1951 Malcom ..... 2/8.1
2,926,406 A * 3/1960 Edwards et al. ..... 24/68 B
3,008,145 A * 11/1961 Austin et al. ..... 2/419
3,041,622 A * 7/1962 Gurtowski ..... 2/8.1
3,079,609 A * 3/1963 Hoffmaster ..... 2/8.1
3,253,281 A * 5/1966 Benner ..... 2/417
3,325,824 A * 6/1967 Donegan ..... 2/8.1
3,447,160 A * 6/1969 Teder ..... 2/209
3,500,474 A * 3/1970 Austin ..... 2/418
3,513,481 A * 5/1970 Nickerson ..... 2/418
3,992,720 A * 11/1976 Nicolinas ..... 2/418
4,727,585 A * 2/1988 Flygstad ..... 381/379
4,783,822 A * 11/1988 Toole et al. ..... 381/379
5,357,654 A * 10/1994 Hsing-Chi ..... 24/68 B
5,590,213 A * 12/1996 Urella et al. ..... 381/370
5,950,245 A * 9/1999 Binduga ..... 2/417
6,219,851 B1 * 4/2001 Fang ..... 2/418
6,314,588 B1 * 11/2001 Fang ..... 2/418

FOREIGN PATENT DOCUMENTS

JP 10023586 1/1998
JP 2006-109202 4/2006

* cited by examiner

*Primary Examiner* — David S. Warren
(74) *Attorney, Agent, or Firm* — The Farrell Law Firm, P.C.

(57) ABSTRACT

Disclosed is a fit adjuster for a neckband type headset, which includes a headset band and a pair of earpieces connected to both ends of the headset band and placed on the ears of a user. The fit adjuster includes at least one opening formed at a stress concentration portion of the headset band; and an adjustment pin inserted into the opening to be movable in a longitudinal direction of the opening.

8 Claims, 6 Drawing Sheets

FIT ADJUSTER FOR A NECKBAND TYPE HEADSET

PRIORITY

This application claims priority under 35 U.S.C §119 to an application entitled "Fit Adjuster For Neckband Type Headset" filed in the Korean Intellectual Property Office on Aug. 11, 2006 and assigned Serial No. 2006-76408, the contents of which are hereby incorporated herein by reference.

BACKGROUND OF THE INVENTION

1. Field of the Invention

The present invention relates generally to a neckband type headset wearable on a particular part of the body, i.e. behind the user's head and neck, and in particular, to a fit adjuster for a neckband type headset using a short distance wireless communication module.

2. Description of the Related Art

Generally, mobile communication terminals refer to handheld devices, which are capable of providing a user and another party with wireless communication services, including voice communication, message transmission, file transmission, video calling and a camera function. Mobile communication terminals can also allow for personal secretary services, such as telephone number management and scheduling.

Mobile communication terminals are becoming smaller, slimmer and sleeker in order to improve portability and are also becoming multimedia devices which can offer multimedia services, for example, entertainment content services like music, videos and games. Mobile communication terminals have gone beyond merely being telephones and are becoming more multifunctional and complex to integrate various additional functions, including video calling, mobile gaming, Internet access and camera functions.

Recently, short distance wireless communication interfaces, such as Bluetooth®, have been applied to mobile terminals.

In addition, headsets that can be worn over the head are generally used with mobile terminals. Particularly, neckband type headsets with improved portability and wearing comfort have attained popularity.

FIGS. 1 and 2 illustrate a conventional wired neckband type headset 10. As illustrated, the conventional neckband type headset 10 has a fit adjustment means for minimizing wearing discomfort according to different head sizes of individual users. The conventional neckband type headset 10 includes an adjustable band 120 and a pair of earpieces attached to both ends of the adjustable band 120. The pair of earpieces are right and left speakers 100 and 110. The adjustable band 120 is held behind the user's head and neck. The right and left speakers 100 and 110 are lined with sponge earpads 111 and 101 providing a soft attachment to the ears. The adjustable band 120 has a property of being retained in its original position.

The adjustable band 120 is generally made from plastic. It consists of a central part 122 and two extending parts 121 and 123, which can be retracted into or withdrawn from the central part 120 to adjust the headset 10 for a comfortable fit. In other words, the conventional neckband type headset 10 has a structure that allows the user to adjust the length of the band 120 according to the size of the user's head to have a comfortable fit.

However, the fit adjustment means adopted in the conventional neckband type headset 10 cannot be applied to headsets equipped with a Bluetooth® module for short-distance wireless communication. A wireless headset with a Bluetooth® module mounts a wire within a head band to electrically connect the right and left speakers, which makes it difficult to adjust the length of the head band. Unlike the head band of a wired neckband type headset, the head band of a wireless neckband type headset is not length-adjustable due to the wire mounted therein. Therefore, a new means for adjusting the fit of a wireless neckband type headset is in high demand.

SUMMARY OF THE INVENTION

Accordingly, the present invention has been made to solve the above-mentioned problems occurring in the prior art, and an object of the present invention is to provide a fit adjuster for a neckband type headset, which can provide long-wearing comfort.

Another object of the present invention is to provide a fit adjuster for a neckband type headset, which can make step-by-step fit adjustment.

Still another object of the present invention is to provide a fit adjuster for a neckband type headset, which allows a user to easily adjust the fit while wearing the headset.

Still another object of the present invention is to provide a fit adjuster for a neckband type headset, which can improve strength of a headset band.

In order to accomplish the above objects of the present invention, there is provided a neckband type headset including a headset band and a pair of earpieces connected to both ends of the headset band and placed on the ears of a user. The neckband type headset further includes a fit adjuster including at least one opening formed at a stress concentration portion of the headset band; and an adjustment pin inserted into the opening to be movable in a longitudinal direction of the opening.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Hereinafter, preferred embodiments of the present invention will be described with reference to the accompanying drawings. In the following description of the invention, detailed descriptions of functions and constructions incorporated herein, which are known to those skilled in the art are omitted for clarity and conciseness.

Figure 1:
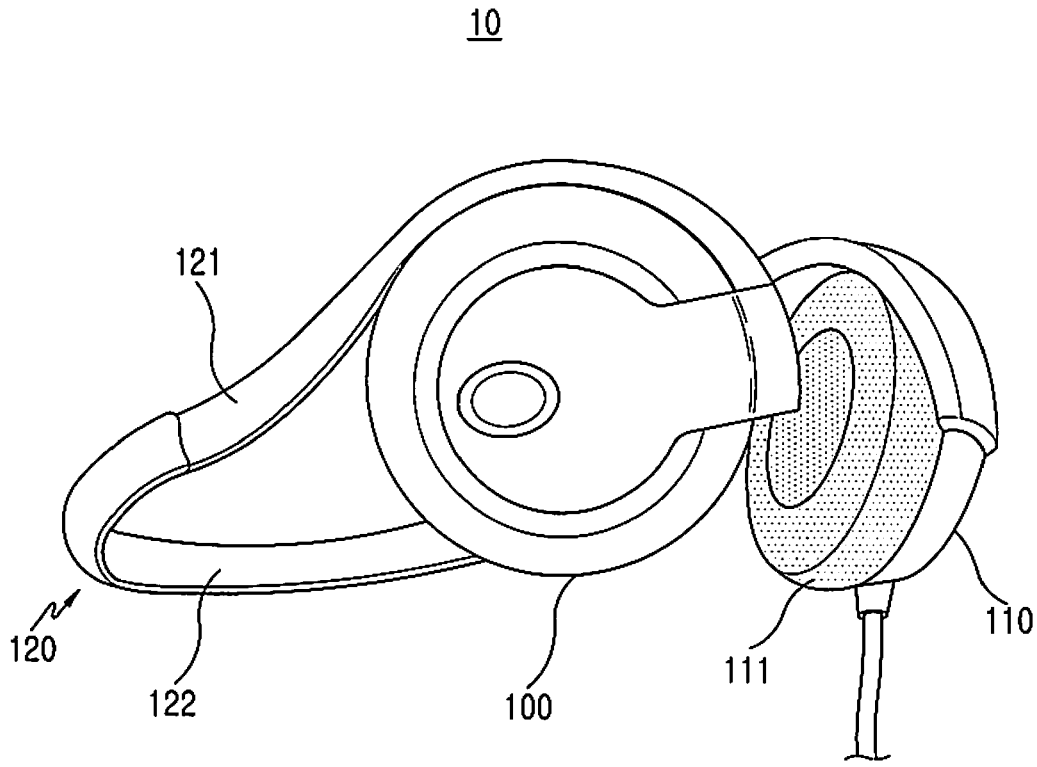
FIG.1 (PRIOR ART)
FIG. 1 is a perspective view of a conventional neckband type headset.
Figure 2:
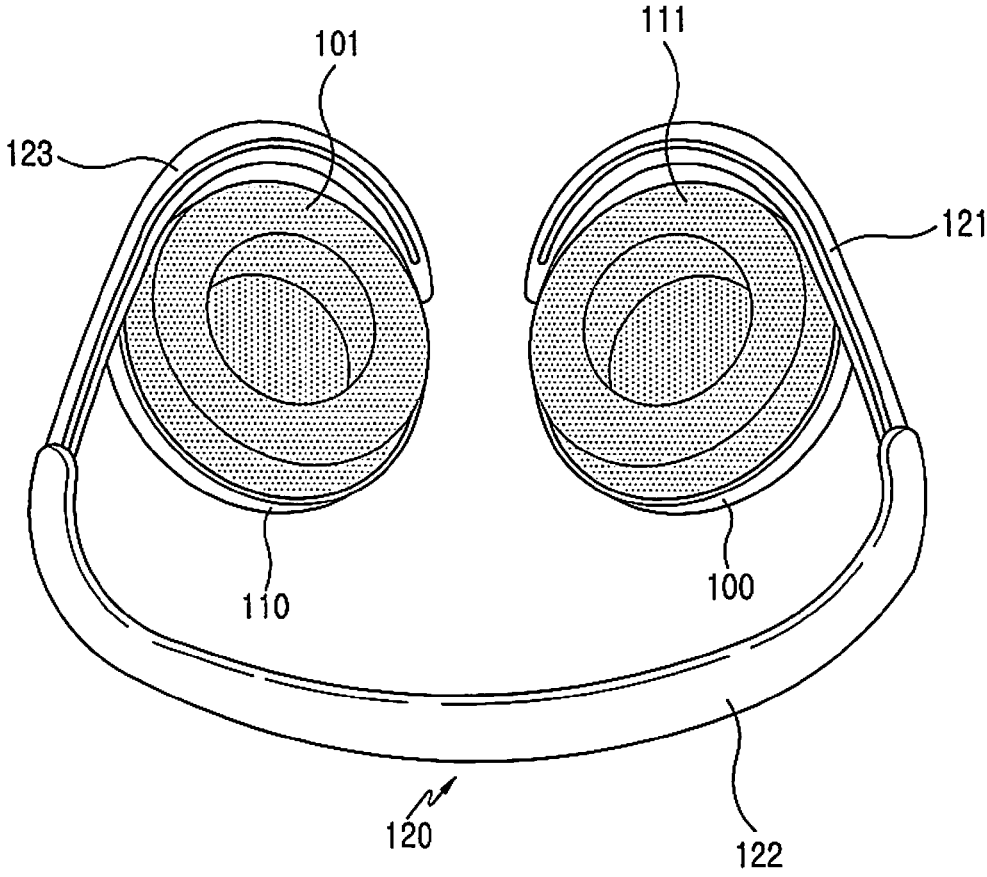
FIG.2 (PRIOR ART)
FIG. 2 is a front view of a conventional neckband type headset.
Figure 3:
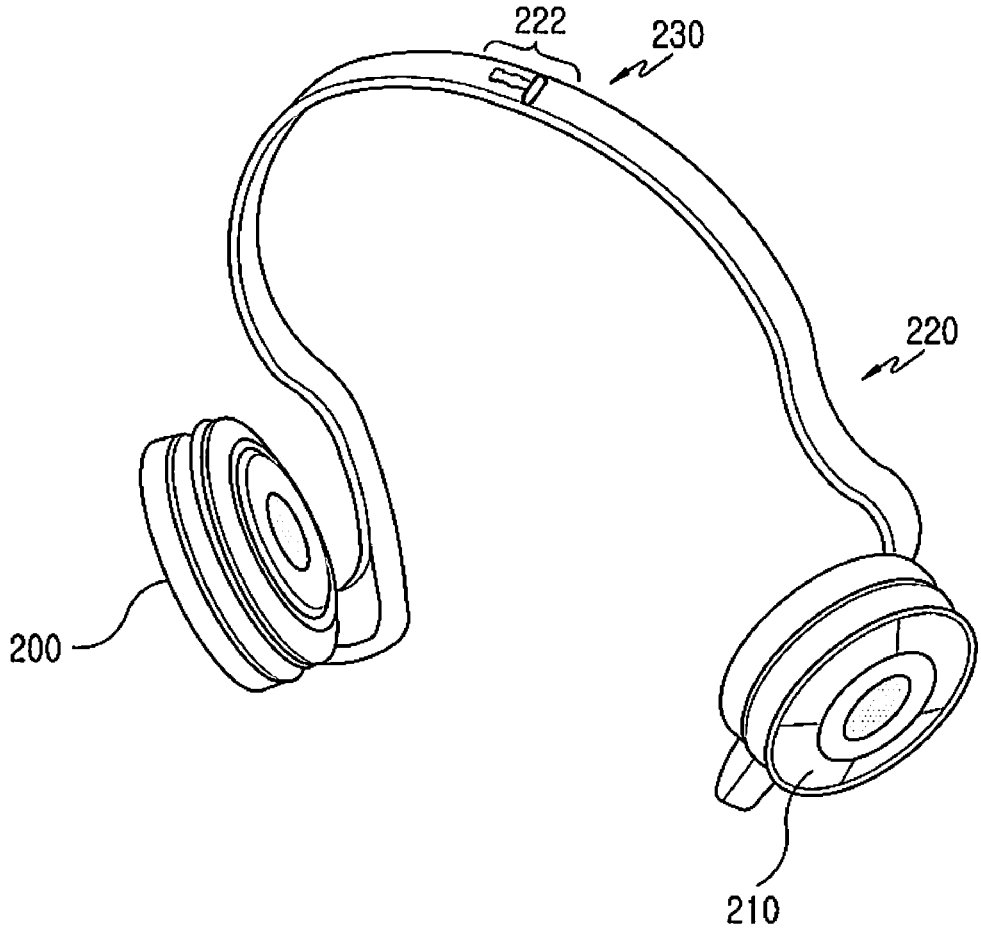
FIG. 3 is a perspective view of a neckband type headset having a fit adjuster according to the present invention.
Figure 4:
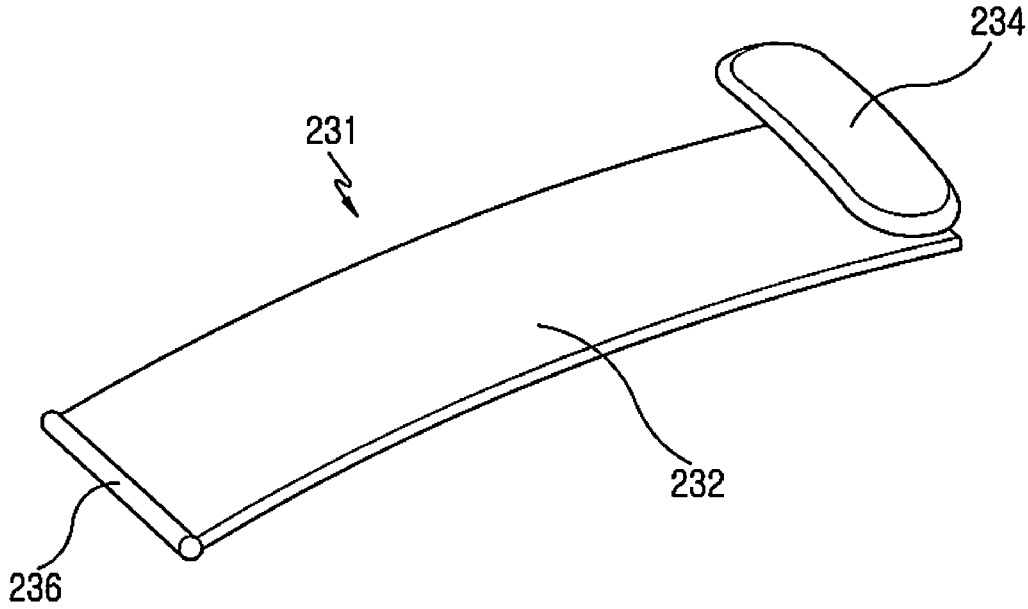
FIG. 4 is a perspective view of a fit adjuster according to the present invention.
Figure 5:
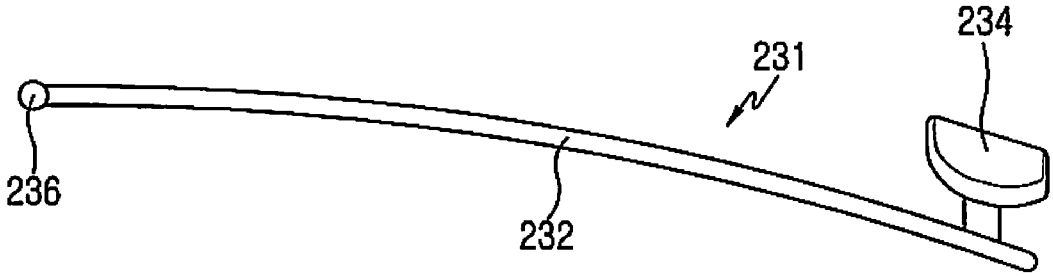
FIG. 5 is a side view of the fit adjuster shown in FIG. 4.

As illustrated in FIGS. 3 through 5, a neckband type headset 20 according to the present invention includes a fit adjuster at a stress concentration portion of a headset band 220 which is placed behind a user's head. More specifically, the fit adjuster is mounted in the stress concentration portion of the headset band 220, which connects a pair of earpieces 200 and 210. The fit adjuster is preferably applied to a neckband type headset using a short distance wireless communication module, for example, a Bluetooth® module. The headset 20 according to the present invention has openings 221 and 223 formed in the headset band 220 and an adjustment pin 231 which can be inserted into the openings 221 and 223.

Figure 6:
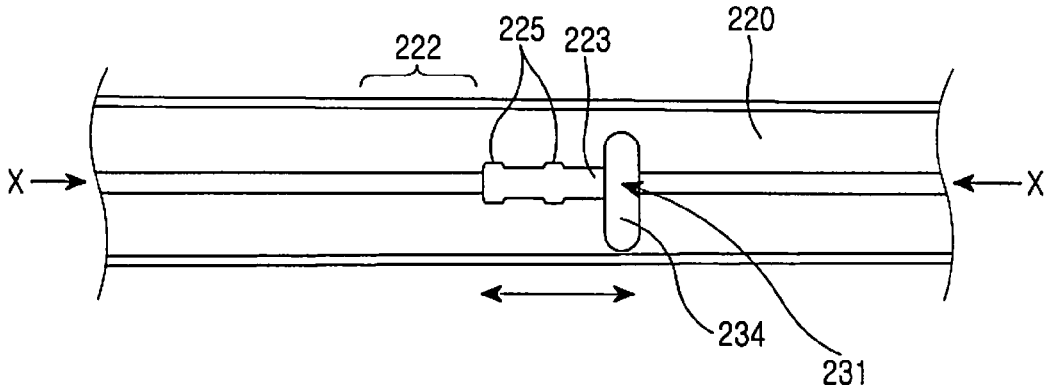
FIG. 6 is a partly enlarged front view of a neckband type headset with a fit adjuster incorporated according to the present invention.
Figure 7:
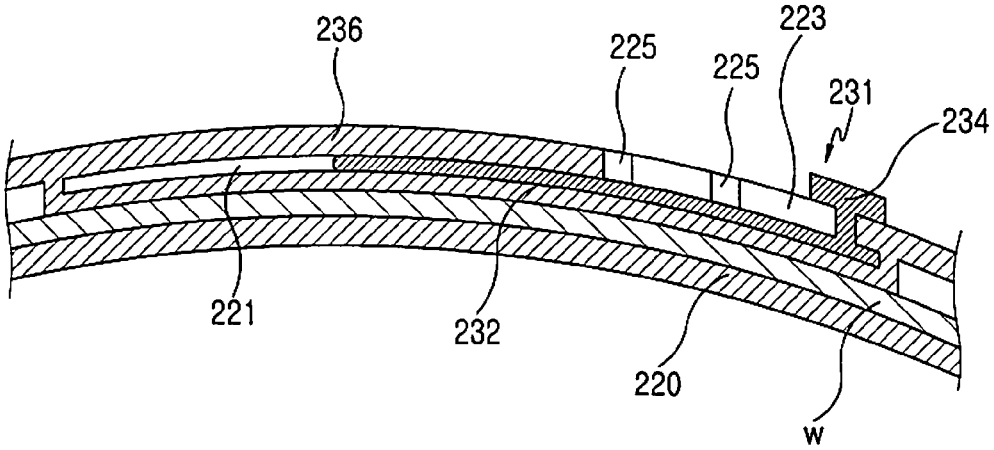
FIG. 7 is a cross-sectional view taken along the line X-X of FIG. 6.

As illustrated in FIGS. 6 and 7, the openings 221 and 223 are formed at the stress concentration portion 222 of the headset band 220, which is symmetrical with respect to the center thereof. Preferably, the stress concentration portion 222 should be provided at the center of the headset band 220. The openings 221 and 223 are formed to movably mount the adjustment pin 231 therein. More specifically, the first opening 221 is longitudinally formed in a tunnel shape within the headset band 220. The second opening 223 is formed on the outer surface of the headset band 220 so as to spatially communicate with the first opening 221. The first opening 221 is hidden inside the headset band 220, whereas the second opening 223 is exposed on the headset band 220.

As illustrated in FIGS. 4, 5 and 7, the adjustment pin 231 is a movable element, which is mounted in the first and second openings 221 and 223. The adjustment pin 231 includes a rigid member 232 longitudinally movable within the first opening 221 and an adjuster knob 234 fixed at one end of the rigid member 232 and protruding outward from the headset band 220. The rigid member 232 is movable within the first opening 221. A neck portion connecting the rigid member 232 and the adjuster knob 234 is movable within the second opening 223. Also, the adjuster knob 234 is movable above the second opening 223.

The rigid member 232 is made from a metal. It is formed in a metal plate shape to effectively absorb the stress transferred to the stress concentration region while the user is wearing the headset 20. The rigid member 232 has a protector 236 formed in a cylindrical shape at the other end thereof. The protector 236 reduces friction generated between the rigid member 232 and the interior of the headset band 220 during movement of the rigid member 231 within the first opening 221. With the reduction of friction, the protector 236 can protect the wall of the first opening 221 in the headset band 220 from easily wearing away.

As illustrated in FIGS. 6 and 7, the fit adjuster of the present invention further includes at least one movement control means 225 provided in a longitudinal direction of the second opening 223. The movement control means 225 is formed in a groove-like shape to allow the step-by-step movement of the adjustment pin 231. It is preferable to provide a pair of movement control means 225 facing each other.

The user can forcibly move the adjustment pin 231 along the first opening. Referring to FIG. 7, when the adjustment pin 231 is moved in a left direction, the user will feel a higher pressure put on the ears. When the adjustment pin 231 is moved in a right direction, the pressure will be reduced.

The fit adjuster according to the present invention is mounted slightly above the longitudinal center of the cross-section of the headset band 220 because of a wire W (FIG. 7) mounted in the band 220 to connect the right and left speakers.

As explained above, the fit adjuster according to the present invention is applicable to a neckband type headset using a short distance wireless communication module. The fit adjuster fits the headset tightly on the back of the neck, thereby preventing the headset from slipping off even during active sports or extended wearing time. The fit adjuster enables users of different head sizes to adjust the length of the headset band and find the most comfortable fit. Since the fit adjuster ensures tight fit on the ears of the user, it can minimize the leakage of sound outputted from the speakers. In addition, the fit adjuster mounted at the stress concentration portion of the headset band can improve the strength of the headset and thereby extend the headset life.

Although preferred embodiments of the present invention have been described for illustrative purposes, those skilled in the art will appreciate that various modifications, additions and substitutions are possible, without departing from the scope and spirit of the invention as disclosed in the accompanying claims, including the full scope of equivalents thereof.

What is claimed is:

1. In a neckband type headset including a headset band and a pair of earpieces connected to both ends of the headset band and placed on the ears of a user, a fit adjuster comprising:

at least one opening formed at a stress concentration portion of the headset band; and an adjustment pin inserted into the opening to be movable in a longitudinal direction of the opening, wherein the adjustment pin includes a rigid member longitudinally movable within a first opening, and an adjuster knob fixed at one end of the rigid member and protruding outward from the headset band, and wherein the rigid member has a protector at the other end thereof.

2. The fit adjuster according to claim 1, wherein opening includes the first opening formed in a tunnel shape within the headset band, and a second opening formed on the outer surface of the headset band so as to spatially communicate with the first opening.

3. The fit adjuster according to claim 2, wherein the second opening includes at least one movement control means provided in a longitudinal direction thereof for control of a step-by-step movement of the adjustment pin.

4. The fit adjuster according to claim 3, wherein the movement control means is formed in a groove-like shape.

5. The fit adjuster according to claim 3, wherein the earpieces are wireless communication enabled.

6. The fit adjuster according to claim 1, wherein the adjustment pin is made from a metal.

7. The fit adjuster according to claim 1, wherein the rigid member is a metal plate.

8. The fit adjuster according claim 1, wherein the protector is formed in a cylindrical shape.

* * * * *